US006289787B1

(12) United States Patent
Underwood et al.

(10) Patent No.: US 6,289,787 B1
(45) Date of Patent: Sep. 18, 2001

(54) VANE ACTUATOR

(75) Inventors: Fred R. Underwood; Richard Scholtz; Ray J. Claxton, all of Dallas, TX (US)

(73) Assignee: K-Tork International, Inc., Dallas, TX (US)

( * ) Notice: Subject to any disclaimer, the term of this patent is extended or adjusted under 35 U.S.C. 154(b) by 0 days.

(21) Appl. No.: 09/419,470

(22) Filed: Oct. 15, 1999

(51) Int. Cl.[7] ..... F01C 9/00
(52) U.S. Cl. ..... 92/121; 92/124; 92/125
(58) Field of Search ..... 92/120, 121, 124, 92/125; 91/339

(56) References Cited

U.S. PATENT DOCUMENTS

| | | | | |
|---|---|---|---|---|
| 3,554,096 | * | 1/1971 | DeJager | 92/125 |
| 3,688,645 | * | 9/1972 | Reaves | 92/125 |
| 4,537,164 | | 8/1985 | Ajiki et al. | 123/90.16 |
| 5,111,847 | | 5/1992 | Hu et al. | 137/828 |
| 5,259,589 | | 11/1993 | Posner | 251/285 |
| 5,487,527 | | 1/1996 | Eggleston | 251/62 |
| 5,735,456 | | 4/1998 | Marin et al. | 236/75 |
| 5,813,316 | | 9/1998 | Sekiya et al. | 92/121 |
| 5,823,092 | | 10/1998 | Granberg | 92/121 |
| 5,915,668 | | 6/1999 | Hodapp et al. | 251/129.13 |
| 5,924,671 | | 7/1999 | Baumann | 251/62 |
| 5,947,422 | | 9/1999 | Shurman et al. | 251/129.19 |

OTHER PUBLICATIONS

Kinetrol brochure on Rotary Actuators, by Kinetrol Ltd., full brochure.

* cited by examiner

*Primary Examiner*—Edward K. Look
*Assistant Examiner*—Michael Leslie
(74) *Attorney, Agent, or Firm*—Akin, Gump, Strauss, Hauer & Feld, LLP; Dwayne L. Mason

(57) ABSTRACT

The vane actuator according to the present invention is capable of operating effectively at a working pressure greater than 100 psig. The vane actuator comprises a vane shaft rotatably extending through a casing and a vane disposed within the casing defining a first pressure chamber and a second pressure chamber therein. The casing includes stiffening members for resisting deflection of and maintaining an internal seal within the casing when exposed to a pressure of 150 psig. The stiffening member may be located in the range of about 10° and 20° on either side of a casing centerline to minimize deflection of the casing when exposed to a pressure force.

68 Claims, 3 Drawing Sheets

VANE ACTUATOR

BACKGROUND

This invention relates to pneumatic and hydraulic actuators of the vane type. This invention further relates to vane type actuators having a clam shaped casing configuration. Actuators are known in the art as the mechanism used to open, close or position valves, dampers, doors, etc. Generally, they may be actuated with a hydraulic fluid or a pneumatic fluid such as air, nitrogen or a process gas. Actuators may be of the on/off variety or my be actuated to a range of positions through the use of a positioner.

Many vane actuator manufactures have settled on a casing design having a clam shaped configuration. For example, one of the leading sellers of vane type actuators, Kinetrol Ltd., has manufactured and sold a vane type actuator having a clam shaped configuration. This casing design is an optimal configuration for actuators having internal vanes of the paddle shaped variety. Other manufacturers such as Matryx and FMC have sold vane type actuators having similar configurations. The actuator case comprises case-halves, which are generally secured together with removable fasteners.

Actuators of the vane type design are very desirable since they may be designed to have only one moving part. This is accomplished by designing and manufacturing the actuator shaft and vane as a single machined piece. The vane is designed to have a minimal clearance between the internal surfaces of the case-halves. A seal may then be disposed on the peripheral surfaces of the vane to minimize leakage of a process fluid from one side of the vane to the other. The case-halves also include a port through which the shaft may extend. A seal may also be disposed between the shaft and the ports to minimize leakage of fluid.

One problem associated with prior art vane actuators is excess leakage of fluid from one side of the vane to the other. This prevents the actuator from maintaining the precise control over the component to be actuated or positioned. In a process plant such as a oil refinery or chemical plant, precise positioning of equipment such as a control valve or damper must be maintained to operate the facility efficiently or to prevent a catastrophic failure. While seal failures are one obvious source of excess leakage, more serious sources of excess leakage include high pressure excursions of the pneumatic or hydraulic fluid as well as expansion or contraction of the casing due to high and low temperatures. These latter sources of excessive leakage are especially notorious since such excursions may permanently damage the actuator often resulting in a loss of containment of the hydraulic or pneumatic fluid. Loss of containment of the pneumatic or hydraulic fluid can cause catastrophic system failures including loss of life and significant property damage.

Another problem associated with prior art vane actuators is that heretofore additional appurtenances were required to mount accessories such as solenoids, positioners, and limit switches. While international standards have been established by NAMUR for mounting accessories, vane actuator manufacturers have failed to design an actuator that complies with the NAMUR standards.

Therefore there is a need in the art for a vane actuator that reduces or eliminates excessive leakage due to high fluid pressures or excursions. There is a need in the art for a vane actuator that reduces or eliminates excessive leakage due to high or low operating temperatures. There is also a need in the art for a vane type actuator that meets NAMUR standards, thereby allowing accessories such as solenoids, limit switches and positioners of any manufacturer to be mounted directly to the vane actuator casing. A vane actuator which meets the above referenced needs is described herein below.

GENERAL DESCRIPTION

A vane actuator according to the present invention comprises a case defined by two case-halves having an exterior and/or interior clam shell shape. Each case-half includes a stiffening member positioned along a central region of each case half to resist deflection based on exposure to high pressure as well as high and low temperature conditions. High pressure as used herein shall mean operating pressures above 100 psig. High temperatures as used herein shall mean operating temperatures above 175 F. Low temperatures as used herein shall mean operating temperatures below −50 F. A vane actuator according to the present invention further comprises a pressure enclosure defined by interior surfaces of the respective case-halves. The pressure enclosure is designed to receive a vane, which defines first and second pressure chambers. Each case-half further includes a port to receive a vane shaft for rotating the vane. The vane shaft may be pivoted by causing a pressure difference within regions on either side of the vane.

In one embodiment of the present invention, the case further comprises suction and exhaust fluid ports as well as a drain port. Further embodiments of the present invention include integral NAMUR mounting surfaces on the exterior of the case to mount accessories such as solenoids, limit switches and positioners.

DETAILED DESCRIPTION

Figure 1:
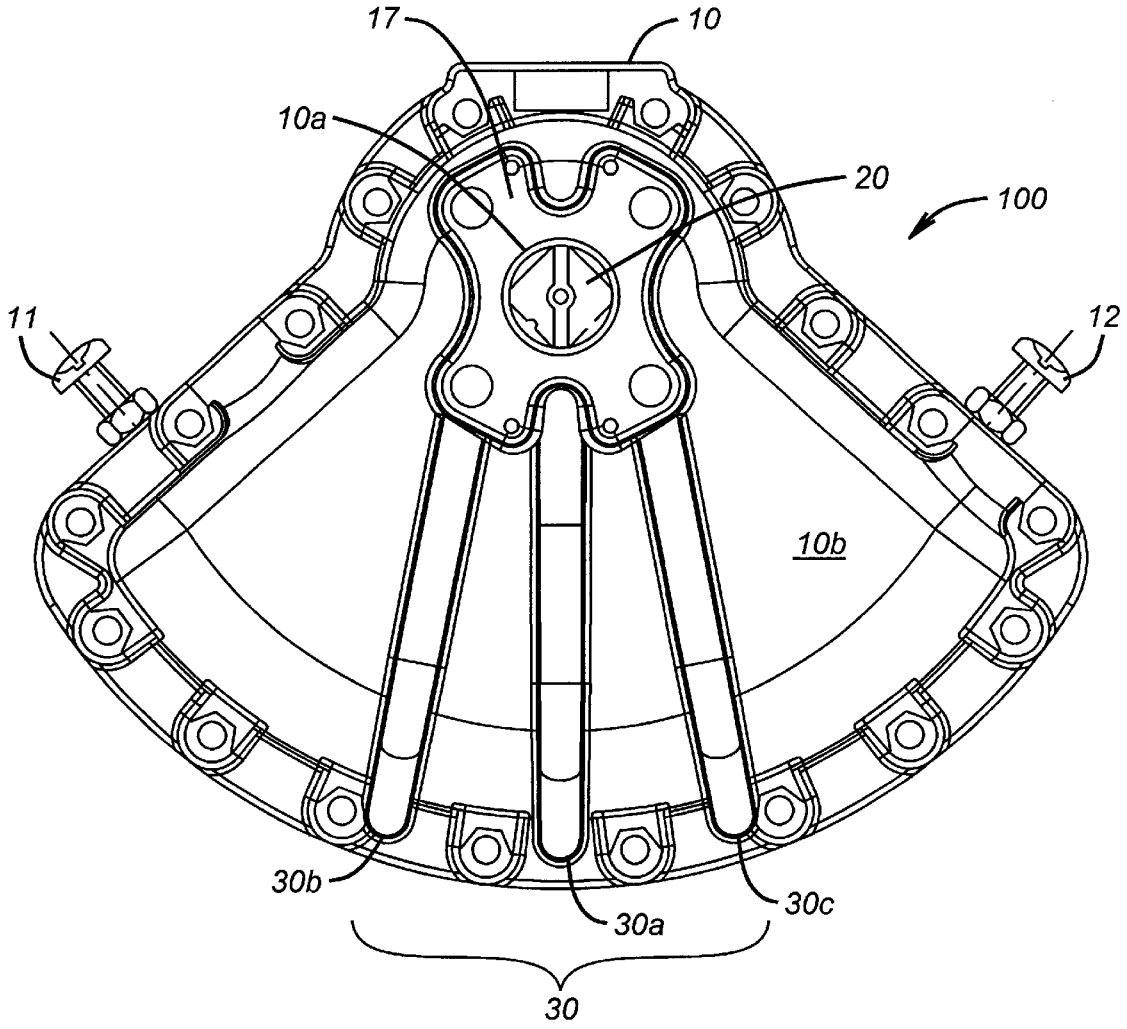
FIG. 1 is a plan view of an actuator in accordance with the present invention.
Figure 2:
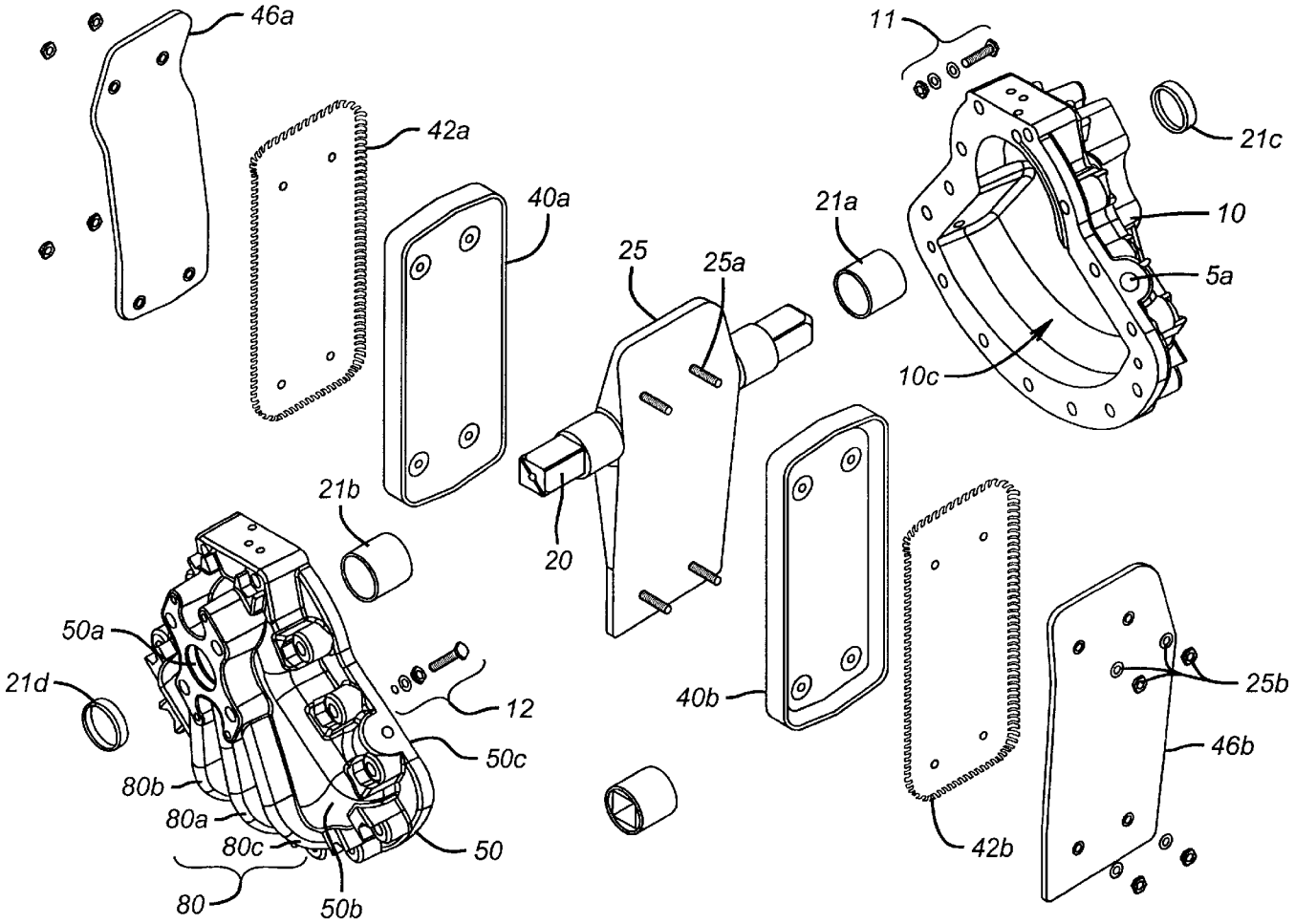
FIG. 2 is a cut away exploded view of an actuator including internal components in accordance with the present invention.
Figure 3:
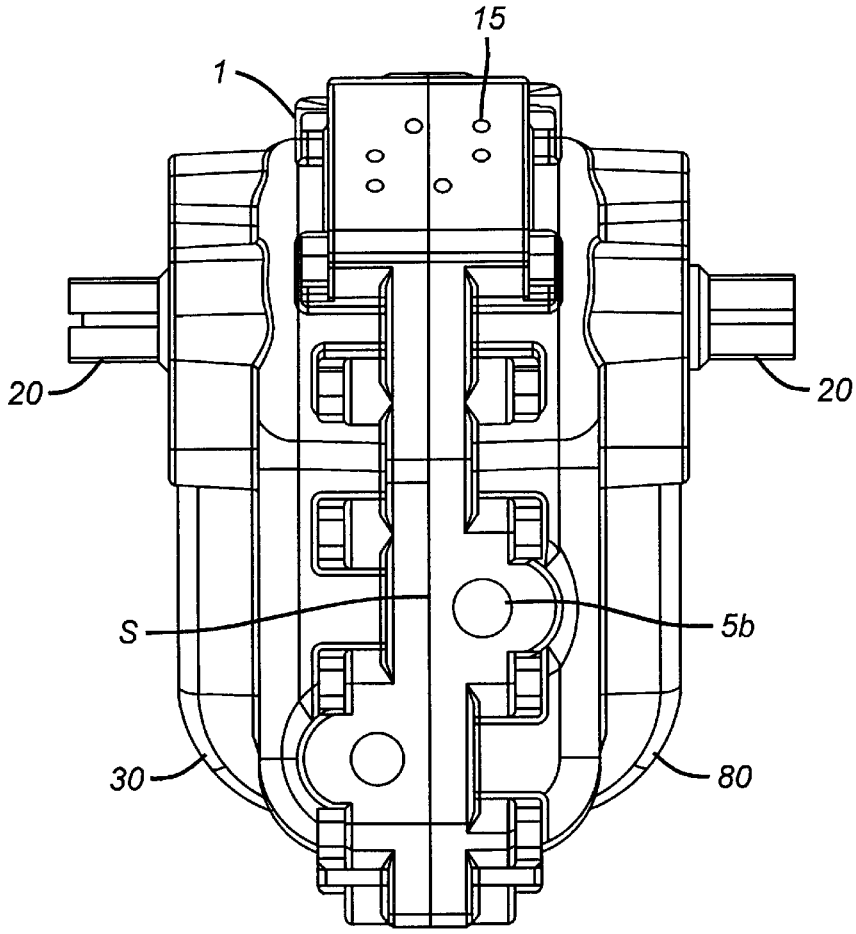
FIG. 3 is a side cross-sectional view of an actuator in accordance with the present invention.

Referring to FIGS. 1, 2 and 3, a vane actuator 100, according to the present invention, is depicted in a top or plan view. Vane actuator 100 includes case 1, comprising top case half 10 and bottom case half 50. Top case half 10 and bottom case half 50 include shaft holes 10*a* and 50*a*, respectively. Shaft holes 10*a* and 50*a* allow a shaft 20 to be rotatably inserted there through. Shaft holes 10*a* and 50*a* also include radial bearings 21*a* and 21*b* secured coaxially to radially support the shaft 20 for rotation as well as seals 21*c* and 21*d* to minimize leakage from the case. Top case half 10 and bottom case half 50 form a clam shell configuration, each case half generally being a mirror image of the other with exceptions as noted below.

Top case half 10 and bottom case half 50 include top stiffening member 30 and bottom stiffening member 80 respectively. In the preferred embodiment top stiffening member 30 comprises stiffeners 30*a*, 30*b* and 30*c*, while bottom stiffening member 80 comprises stiffeners 80*a*, 80*b* and 80*c*. The stiffeners and thus the respective stiffening members extend from exterior surfaces 10*b* and 50*b* on case halves 10 and 50. Stiffeners 30*a* and 80*a* are positioned along the radial centerline of actuator 100. In the preferred embodiment, the center lines of stiffeners 30*b* and 30*c* are positioned 11° on either side of stiffener 30*a* as measured centerline to centerline. Similarly, in the preferred embodiment, the center lines of stiffeners 80*b* and 80*c* are positioned 11° on either side of stiffener 80*a* as measured centerline to centerline. While the preferred embodiment shows 3 stiffeners, one or a plurality of stiffener(s) may be employed within the range noted above on either side of the centerline of actuator 100. One or more stiffeners may be positioned within the range between about 10° and 20° on either side of the centerline of actuator 100 for the purpose of minimizing deflection of the case when exposed to a working temperature range of −50 F. to 300 F., and/or a maximum working pressure of 150 psig and/or a maximum overload pressure of 220 psig. In the preferred embodiment, each case half comprises a monolithic casting of A380 or A356 grade aluminum.

Shaft 20 includes a paddle shaped vane 25 located along the radial center of the shaft 20. In the preferred embodiment, shaft 20 and vane 25 comprise a monolithic structure machined from a suitable alloy steel. The vane 25 is designed to rotatably travel within a pressure vessel defined by interior surface 10*c* of top case half 10 and interior surface 50*c* of bottom case half 50. The pressure vessel is divided into two pressurizable sections defined by the vane 25 and shaft 20. The pressurizable sections may be pressurized and depressurized through ports 5*a* and 5*b* of case half 10 and case half 50 respectively.

Leakage between the pressurizable sections is minimized through the use of a seal assembly. To secure the seal assembly, Vane 25 may include integral bolts which may extend through bolt holes in the seal assembly. In the preferred embodiment the vane seal assembly comprises vane seals 40*a* and 40*b*, which are made from a durable and flexible material such as a polyurethane or a fluroelastomer. The vane seals 40*a* and 40*b* have exterior wall surfaces which extend away from a flat base surface, which contains bolt holes for receiving the bolts on vane 25. In the preferred embodiment, a back of the flat base surface is disposed against vane faces of vane 25. In the preferred embodiment, stainless steel expanders 42*a* and 42*b* are disposed against a front of the flat base surface on the vane seals 40*a* and 40*b*. The expanders 42*a* and 42*b* exert a spring type force so as to force the vane seals 40*a* and 40*b* against the interior surfaces 10*c* and 50*c* of the case 1. Expanders 42*a* and 42*b* also include bolt holes designed to receive the bolts on vane 25. Side plates 46*a* and 46*b* are disposed against the expanders 42*a* and 42*b* and have bolt holes to receive the vane bolts 25*a* to retain the vane seals 40*a* and 40*b* and the expanders 42*a* and 42*b* against the vane 25. Finally, nut and washer assemblies 25*b* are threadedly connected to the vane bolts 25*a* to secure the seal assembly. While the preferred embodiment includes the seal assembly as described above, other seal solutions may be envisioned by those skilled in the art. Examples include a system similar to the one described above, but employing the seal assembly only on one face of the vane. Furthermore, a simple o-ring may be disposed within a groove along the peripheral edges of the vane 25 to engage against the interior surfaces 10*c* and 50*c*. In a further embodiment, expanders may be located on either side of a T-shaped seal, all of which may be disposed at one end within a slot along the peripheral edges of the vane 25 to engage against the interior surfaces 10*c* and 50*c*. In an even further embodiment an expander may be located on one or both sides of an L-shaped seal, and similarly the expander and L-shaped seal may be disposed at one end within a slot along the peripheral edges of the vane 25 to engage against the interior surfaces 10*c* and 50*c*.

Top case half 10 and bottom case half 50 may be bolted or otherwise secured together such that a seam S is formed there between. The connection of top case half 10 to bottom case half 50 defines a pressure chamber within the actuator case 1. It can be seen that the manner in which the case halves 10 and 50 are joined together form clam-shell shaped actuator 100.

This clam-shell shaped structure is quite like the clam-shell shaped actuators well known in the art. This configuration readily allows a user to replace the prior art low pressure/low temperature actuators with the high pressure/higher temperature actuators of the present invention, while maintaining substantially the same footprint dimensions of the prior art actuators. This is particularly beneficial to end users since an actuator that is dimensionally different may result in interferences with other pre-existing equipment or structures.

In the preferred embodiment, the exterior surfaces 10*b* and 50*b* of the respective case halves 10 and 50 are sloped so as to eliminate pockets or surface cavities, which could be collection points for corrosive fluids. Cavities on the exterior surfaces of prior art case halves are known to be sources for corrosion. Over time, these areas of corrosion can lead to actuator failure and loss of containment of potentially hazardous fluids. In the preferred embodiment, travel stops 11 and 12 extend through side surfaces of case half 10 and case half 50 respectively and into the pressurizable sections to engage against the vane 25 so as to limit the travel of the vane 25 and to protect the case 1 from damage.

Figure 4:
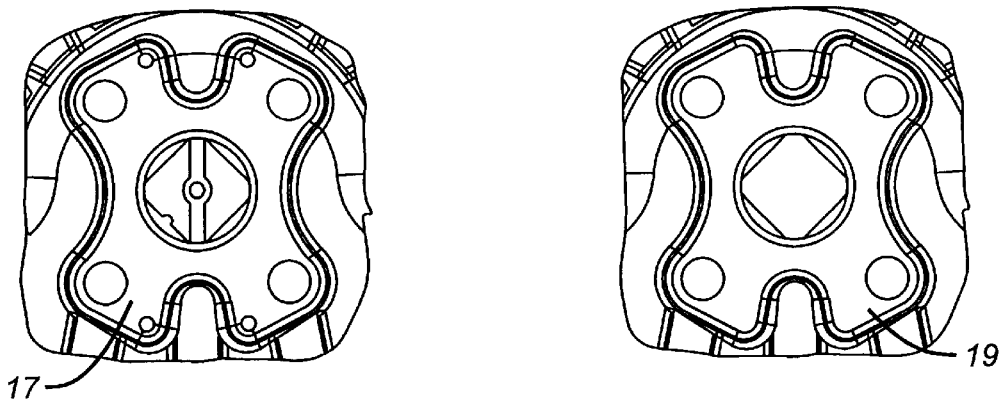
FIG. 4 is a plan view of the NAMUR and bracket mounting for an actuator in accordance with the present invention.

Referring now to FIGS. 1, 3 and 4, integral NAMUR VDI/VDE 3845 and bracket mounting surfaces are disclosed for mounting solenoids, positioners and limit switches and brackets for connecting to the component to be actuated, e.g., valve, damper, door, etc. In the preferred embodiment, side surfaces of case half 10 and case half 50 comprise an integral solenoid mounting 15. Case half 10 further comprises a positioner/limit switch mounting 17. Case half 50 further comprises a bracket mounting 19 for retaining the actuator 100 to the equipment to be actuated.

Techniques and advantages over the prior art apparatus are illustrated in the following non-limiting example:

EXAMPLE 1

Table 1 includes results from a finite elemental analysis which compares the performance of the prior art Kinetrol actuator with embodiments according to the present invention. The embodiments of the present invention analyzed were Models K1–K6 manufactured by K-Tork International, Inc. Each actuator was computer modeled to conform to the respective actuator specifications. Once modeled each actuator was internally pressured at ambient temperatures to analyze deflections. The overall size, dimensions and torque outputs of the respective actuators were held constant. The results show that the displacement magnitude and maximum displacement for the present invention K-Tork actuators are less than that of the prior art Kinetrol actuator of the same size. The deflections of the K-Tork actuators at 150 psig are less than or equal to the Kinetrol actuator when they were pressurized to 100 psig. The torque outputs (inch-lbs.) for the K-Tork models K1–K6 and the Kinetrol models 01–06 are 1080, 2280, 4992, 12000, 27000, and 60000 respectively.

TABLE 1

| Actuator Type | Displacement Magnitude | |
|---|---|---|
| | Maximum | Minimum |
| K-Tork Model K1 | 8.471 E-04 | 1.996 E-06 |
| Kinetrol Model 01 | 9.201 E-04 | 6.828 E-06 |
| K-Tork Model K2 | 1.036 E-03 | 1.425 E-06 |
| Kinetrol Model 02 | 1.221 E-03 | 6.280 E-07 |
| K-Tork Model K3 | 1.603 E-03 | 1.641 E-05 |
| Kinetrol Model 03 | 2.124 E-03 | 4.688 E-06 |
| K-Tork Model K4 | 2.471 E-03 | 9.836 E-06 |
| Kinetrol Model 04 | 4.575 E-03 | 4.760 E-06 |
| K-Tork Model K5 | 3.070 E-03 | 1.024 E-03 |
| Kinetrol Model 05 | 3.445 E-03 | 5.363 E-03 |
| K-Tork Model K6 | 4.289 E-03 | 2.824 E-06 |
| Kinetrol Model 06 | 5.098 E-03 | 6.243 E-05 |

While the invention has been described in detail and with reference to specific embodiments thereof, it will be apparent to one skilled in the art that various changes and modifications can be made therein without departing from the spirit and scope thereof. It is to be understood that all matter herein set forth or shown in the accompanying tables and figures is to be interpreted as illustrative and not in a limiting sense. Accordingly, the foregoing description should be regarded as illustrative of the invention whose full scope is measured by the following claims.

What is claimed is:

1. A clam shell shaped vane actuator, said actuator comprising:

a top case having a top surface comprising a top stiffener, wherein an outermost edge of said top stiffener extends no more than about 20° on either side of a center line of positioned along a central region of said top surface to resist deflection thereof, said top case including an top central section for receiving a vane, and including an upper bore for rotatably receiving a vane shaft;

a bottom case having a lower surface comprising a bottom stiffener, wherein an outermost edge of said bottom stiffener extends no more than 20° on either side of a center line of said bottom case, the said lower case including a lower central section for receiving a vane, and including a lower bore for rotatably receiving a vane shaft, said lower case connected to said upper case forming a casing;

said top case and said bottom case forming a sealed vessel, said vane attached to said shaft for dividing said sealed vessel into a first pressure chamber and a second pressure chamber, and wherein the shaft may be pivoted between the first pressure chamber and the second pressure chambers; and a first hydraulic port extending through said top case half and a second hydraulic port extending through said bottom case half, in communication with said sealed vessel.

2. The actuator of claim 1, wherein the top stiffening member and the bottom stiffening member are within the range of about 10° and 20° on either side of a casing centerline.

3. The actuator of claim 2, wherein said stiffening member comprises a left rib, center rib, and a right rib, wherein said center rib is positioned along the center line of said casing and wherein said left rib and said right rib are disposed an equal distance from said center rib and a center line of said center rib is positioned about 11° from a center line of said left rib and a center line of said right rib.

4. The actuator of claim 3, wherein the sealed vessel comprises a NAMUR accessory mounting pad for mounting limit switches and positioners, wherein the NAMUR accessory mounting pad and said sealed vessel form a unitary structure.

5. The actuator of claim 4, wherein the sealed vessel further comprises a NAMUR solenoid mounting pad for mounting a solenoid valve, wherein the NAMUR solenoid mounting pad and said sealed vessel form a unitary structure.

6. The actuator of claim 5, further comprising a solenoid connected to said NAMUR solenoid mounting pad.

7. The actuator of claim 5, wherein the sealed vessel further comprises an operating temperature rating less than −5 F and greater than +175 F.

8. The actuator of claim 7, wherein the sealed vessel further comprises a working pressure rating greater than 100 psig.

9. The actuator of claim 8, wherein said sealed vessel further comprises dual adjustable travel stops.

10. A clam shell shaped vane actuator, said actuator comprising:

a top case having a top surface comprising a top stiffener positioned along a central region of said top surface to resist deflection thereof, said top case including an top central section for receiving a vane, and including an upper bore for rotatably receiving a vane shaft;

a bottom case having a lower surface comprising a bottom stiffener positioned along a central region of said bottom surface to resist deflection thereof, said lower case including a lower central section for receiving a vane, and including a lower bore for rotatably receiving a vane shaft, said lower case connected to said upper case forming a casing;

said top case and said bottom case forming a sealed vessel, said vane attached to said shaft for dividing said sealed vessel into a first pressure chamber and a second pressure chamber, and wherein the shaft may be between the first pressure chamber and the second pressure chamber; and a first hydraulic port extending through said top case half and a second hydraulic port extending through said bottom case half, in communication with said sealed vessel, wherein said casing has a maximum displacement magnitude of less than 5.0 E-04, when the torque output is 1080 inch-lbs., at an operating pressure of 100 psig.

11. A clam shell shaped vane actuator, said actuator comprising:

a top case having a top surface comprising a top stiffener positioned along a central region of said top surface to resist deflection thereof, said top case including an top central section for receiving a vane, and including an up-per bore for rotatably receiving a vane shaft;

a bottom case having a lower surface comprising a bottom stiffener positioned along a central region of said bottom surface to resist deflection thereof, said lower case including a lower central section for receiving a vane, and including a lower bore for rotatably receiving a vane shaft, said lower case connected to said upper case forming a casing;

said top case and said bottom case forming a sealed vessel, said vane attached to said shaft for dividing said sealed vessel into a first pressure chamber and a second pressure chamber, and wherein the shaft may be between the first pressure chamber and the second pressure chamber, and a first hydraulic port extending through said top case half and a second hydraulic port extending through said bottom case half, in communication with said sealed vessel, wherein said casing has a maximum displacement magnitude of less than 1.1 E-03, when the torque output is 2280 inch-lbs., at an operating pressure of 100 psig.

12. A clam shell shaped vane actuator, said actuator comprising:

a top case having a top surface comprising a top stiffener positioned along a central region of said top surface to resist deflection thereof, said top case including an top central section for receiving a vane, and including an upper bore for rotatably receiving a vane shaft;

a bottom case having a lower surface comprising a bottom stiffener positioned along a central region of said bottom surface to resist deflection thereof, said lower case including a lower central section for receiving a vane, and including a lower bore for rotatably receiving a vane shaft, said lower case connected to said upper case forming, a casing;

said top case and said bottom case forming a sealed vessel, said vane attached to said shaft for dividing said sealed vessel into a first pressure chamber and a second pressure chamber, and wherein the shaft may be between the first pressure chamber and the second pressure chamber; and a first hydraulic port extending through said top case half and a second hydraulic port extending through said bottom case half, in communication with said sealed vessel, wherein said casing has a maximum displacement magnitude of less than 5.0 E-04, when the torque output is 1080 inch-lbs., at an operating pressure of 100 psig.

13. The actuator of claim 12, further comprising a limit switch connected to a NAMUR accessory mounting pad.

14. The actuator of claim 12, further comprising a positioner connected to a NAMUR accessory mounting pad.

15. A clam shell shaped vane actuator, said actuator comprising:

a top case having a top surface comprising a top stiffener positioned along a central region of said top surface to resist deflection thereof, said top case including, an top central section for receiving a vane, and including an upper bore for rotatably receiving a vane shaft, a bottom case having a lower surface comprising a bottom stiffener positioned along a central region of said bottom surface to resist deflection thereof, said lower case including a lower central section for receiving a vane, and including a lower bore for rotatably receiving a vane shaft, said lower case connected to said upper case forming a casing;

said top case and said bottom case forming a sealed vessel, said vane attached to said shaft for dividing said sealed vessel into a first pressure chamber and a second pressure chamber, and wherein the shaft may be between the first pressure chamber and the second pressure chamber; and a first hydraulic port extending through said top case half and a second hydraulic port extending through said bottom case half, in communication with said sealed vessel, wherein said casing has a maximum displacement magnitude of less than 2.0 E-03, when the torque output is 4992 inch-lbs., at an operating pressure of 100 psig.

16. A clam shell shaped vane actuator, said actuator comprising:

a top case having a top surface comprising a top stiffener positioned along a central region of said top surface to resist deflection thereof, said top case including, an top central section for receiving a vane, and including an upper bore for rotatably receiving a vane shaft, a bottom case having a lower surface comprising a bottom stiffener positioned along a central region of said bottom surface to resist deflection thereof, said lower case including a lower central section for receiving a vane, and including a lower bore for rotatably receiving a vane shaft, said lower case connected to said upper case forming a casing;

said top case and said bottom case forming a sealed vessel, said vane attached to said shaft for dividing said sealed vessel into a first pressure chamber and a second pressure chamber, and wherein the shaft may be between the first pressure chamber and the second pressure chamber; and a first hydraulic port extending through said top case half and a second hydraulic port extending through said bottom case half, in communication with said sealed vessel, wherein said casing has a maximum displacement magnitude of less than 3.4 E-03, when the torque output is 27000 inch-lbs., at an operating pressure of 100 psig.

17. A clam shell shaped vane actuator, said actuator comprising:

a top case having a top surface comprising a top stiffener positioned along a central region of said top surface to resist deflection thereof, said top case including, an top central section for receiving a vane, and including an upper bore for rotatably receiving a vane shaft, a bottom case having a lower surface comprising a bottom stiffener positioned along a central region of said bottom surface to resist deflection thereof, said lower case including a lower central section for receiving a vane, and including a lower bore for rotatably receiving a vane shaft, said lower case connected to said upper case forming a casing;

said top case and said bottom case forming a sealed vessel, said vane attached to said shaft for dividing said sealed vessel into a first pressure chamber and a second pressure chamber, and wherein the shaft may be between the first pressure chamber and the second pressure chamber; and a first hydraulic port extending through said top case half and a second hydraulic port extending through said bottom case half, in communication with said sealed vessel, wherein said casing has a maximum displacement magnitude of less than 5.0 E-04, when the torque output is 60000 inch-lbs., at an operating pressure of 100 psig.

18. A clam-shell shaped vane actuator comprising:

a casing having a NAMUR mounting pad, wherein the NAMUR mounting pad and said casing form a unitary structure;

a vane shaft, comprising a vane disposed within said casing and defining a first pressure chamber and a second pressure chamber therein, wherein said vane shaft further comprises a shaft rotatably extending through said casing; and wherein said casing further comprises a stiffening member disposed about a center line of said casing.

19. The actuator of claim 18, wherein the stiffening member is within the range of about 10° and 20° on either side of the centerline of the casing.

20. The actuator of claim 19, wherein said stiffening member comprises a left rib, center rib, and a right rib, wherein said center rib is positioned along the center line of said casing and wherein said left rib and said right rib are disposed an equal distance from said center rib and a center line of said center rib is positioned about 11° from a center line of said left rib and a center line of said right rib.

21. The actuator of claim 20, wherein the NAMUR mounting pad is capable of receivably mounting limit switches and positioners.

22. The actuator of claim 21, wherein the casing further comprises a NAMUR solenoid mounting pad for mounting a solenoid valve, wherein the NAMUR solenoid mounting pad and said casing form a unitary structure.

23. The actuator of claim 22, wherein said casing further comprises dual adjustable travel stops.

24. The actuator of claim 23, further comprising a solenoid is attached to said NAMUR solenoid mounting pad.

25. The actuator of claim 24, further comprising a limit switch connected to said NAMUR mounting pad.

26. The actuator of claim 24, further comprising a positioner attached to said NAMUR mounting pad.

27. The actuator of claim 18, wherein the casing further comprises an operating temperature rating less than −5 F and greater than +175 F.

28. The actuator of claim 18, wherein the casing further comprises a working pressure rating of 150 psig.

29. The actuator of claim 18, wherein said casing has a maximum displacement magnitude of less than 9.0 E-04, when the torque output is 1080 inch-lbs., at an operating pressure of 100 psig.

30. The actuator of claim 18, wherein said casing has a maximum displacement magnitude of less than 1.1 E-03, when the torque output is 2280 inch-lbs., at an operating pressure of 100 psig.

31. The actuator of claim 18, wherein said casing further comprises a maximum displacement magnitude of less than 2.0 E-03, when the torque output is 4992 inch-lbs., at an operating pressure of 100 psig.

32. The actuator of claim 18, wherein said casing further comprises a maximum displacement magnitude of less than 2.4 E-03, when the torque output is 12000 inch-lbs., at an operating pressure of 100 psig.

33. The actuator of claim 18, wherein said casing further comprises a maximum displacement magnitude of less than 3.4 E-03, when the torque output is 27000 inch-lbs., at an operating pressure of 100 psig.

34. The actuator of claim 18, wherein said casing further comprises a maximum displacement magnitude of less than 5.0 E-04, when the torque output is 60000 inch-lbs., at an operating pressure of 100 psig.

35. A clam-shell shaped vane actuator comprising:

a casing defining a pressure chamber, said pressure chamber having a vane shaft assembly including a shaft and a vane disposed therein, wherein said vane defines a first pressure chamber and a second pressure chamber within the casing;

said shaft rotatably extending axially through said casing;

said casing having a first NAMUR mounting pad, wherein the NAMUR mounting pad and said casing form a unitary structure.

36. The actuator of claim 35, further comprising a stiffening member positioned within the range of about 10° and 20° on either side of a casing centerline on an exterior surface of the casing.

37. The actuator of claim 36, wherein said stiffening member comprises a left rib, center rib, and a right rib, wherein said center rib is positioned along the center line of said casing and wherein said left rib and said right rib are disposed an equal distance from said center rib and a center line of said center rib is positioned about 11° from a center line of said left rib and a center line of said right rib.

38. The actuator of claim 36, wherein the first NAMUR mounting pad is capable of receivably mounting a limit switch or a positioner.

39. The actuator of claim 38, wherein the casing further comprises a second NAMUR mounting pad capable of receivably mounting a solenoid valve.

40. The actuator of claim 39, wherein said casing further comprises a working pressure rating is 150 psig.

41. The actuator of claim 40, wherein said casing further comprises dual adjustable travel stops.

42. The actuator of claim 41, further comprising a solenoid is attached to said NAMUR solenoid mounting pad.

43. The actuator of claim 42, further comprising a limit switch connected to said NAMUR accessory mounting pad.

44. The actuator of claim 42, further comprising a positioner attached to said NAMUR accessory mounting pad.

45. The actuator of claim 35, wherein the casing further comprises an operating temperature rating from about −50 F to about +300 F.

46. The actuator of claim 35, wherein said casing further comprises a maximum displacement magnitude of less than 9.0 E-04, when the torque output is 1080 inch-lbs., at an operating pressure of 100 psig.

47. The actuator of claim 35, wherein said casing further comprises a maximum displacement magnitude of less than 1.1 E-03, when the torque output is 2280 inch-lbs., at an operating pressure of 100 psig.

48. The actuator of claim 35, wherein said casing further comprises a maximum displacement magnitude of less than 2.0 E-03, when the torque output is 4992 inch-lbs., at an operating pressure of 100 psig.

49. The actuator of claim 35, wherein said casing further comprises a maximum displacement magnitude of less than 2.4 E-03, when the torque output is 12000 inch-lbs., at an operating pressure of 100 psig.

50. The actuator of claim 35, wherein said casing further comprises a maximum displacement magnitude of less than 3.4 E-03, when the torque output is 27000 inch-lbs., at an operating pressure of 100 psig.

51. The actuator of claim 35, wherein said casing further comprises a maximum displacement magnitude of less than 5.0 E-04, when the torque output is 60000 inch-lbs., at an operating pressure of 100 psig.

52. A clam-shell shaped vane actuator comprising:

a casing comprising stiffening means, wherein an outermost edge of said stiffening means extends no more than 20° on either side of a center line of said casing; and a vane shaft, comprising a vane disposed within said casing and defining a first pressure chamber and a second pressure chamber therein, wherein said vane shaft further comprises a shaft rotatably extending through said casing.

53. The actuator of claim 52, wherein said stiffening means is positioned within a range of about 10° and 20° on either side of a casing centerline.

54. The actuator of claim 53, wherein said stiffening means comprises a left rib, center rib, and a right rib, wherein said center rib is positioned along the center line of said casing and wherein said left rib and said right rib are disposed an equal distance from said center rib and a center line of said center rib is positioned about 11° from a center line of said left rib and a center line of said right rib.

55. The actuator of claim 54, wherein the casing comprises a NAMUR accessory mounting pad for mounting limit switches and positioners.

56. The actuator of claim 55, wherein the casing further comprises a NAMUR solenoid mounting pad for mounting a solenoid valve.

57. The actuator of claim 56, wherein the casing further comprises an operating temperature rating from about =31 50 F to about +300 F.

58. The actuator of claim 57, wherein the casing has a working pressure rating of 150 psig.

59. The actuator of claim 58, further comprising a limit switch connected to said NAMUR accessory mounting pad.

60. The actuator of claim 59, further comprising a positioner attached to said NAMUR accessory mounting pad.

61. The actuator of claim 56, further comprising a solenoid attached to said NAMUR solenoid mounting pad.

62. The actuator of claim 52, wherein said casing further comprises a maximum displacement magnitude of less than 9.0 E-04, when the torque output is 1080 inch-lbs., at an operating pressure of 100 psig.

63. The actuator of claim 52, wherein said casing further comprises a maximum displacement magnitude of less than 1.1 E-03, when the torque output is 2280 inch-lbs., at an operating pressure of 100 psig.

64. The actuator of claim 52, wherein said casing further comprises a maximum displacement magnitude of less than 2.0 E-03, when the torque output is 4992 inch-lbs., at an operating pressure of 100 psig.

65. The actuator of claim 52, wherein said casing further comprises a maximum displacement magnitude of less than 2.4 E-03, when the torque output is 12000 inch-lbs., at an operating pressure of 100 psig.

66. The actuator of claim 52, wherein said casing further comprises a maximum displacement magnitude of less than 3.4 E-03, when the torque output is 27000 inch-lbs., at an operating pressure of 100 psig.

67. The actuator of claim 52, wherein said casing further comprises a maximum displacement magnitude of less than 5.0 E-04, when the torque output is 60000 inch-lbs., at an operating pressure of 100 psig.

68. The actuator of claim 52, wherein said casing further comprises dual adjustable travel stops.

* * * * *